US007429809B2

(12) United States Patent
Huster et al.

(10) Patent No.: US 7,429,809 B2
(45) Date of Patent: Sep. 30, 2008

(54) DRIVING MOTOR, ESPECIALLY FOR A PUMP

(75) Inventors: Bernd Huster, Munchberg (DE); Wolfgang Geier, Hof (DE)

(73) Assignee: EMU Unterwasserpumpen GmbH, Hoff (DE)

( * ) Notice: Subject to any disclaimer, the term of this patent is extended or adjusted under 35 U.S.C. 154(b) by 444 days.

(21) Appl. No.: 10/513,356

(22) PCT Filed: May 7, 2003

(86) PCT No.: PCT/DE03/01462

§ 371 (c)(1),
(2), (4) Date: Mar. 1, 2005

(87) PCT Pub. No.: WO03/095842

PCT Pub. Date: Nov. 20, 2003

(65) Prior Publication Data

US 2005/0214141 A1 Sep. 29, 2005

(30) Foreign Application Priority Data

May 7, 2002 (DE) ..... 102 20 477
Apr. 16, 2003 (DE) ..... 103 17 492

(51) Int. Cl.
*H02K 9/00* (2006.01)

(52) U.S. Cl. ..... 310/54; 310/52

(58) Field of Classification Search ..... 310/52–59, 310/62–63, 87–89; 417/420
See application file for complete search history.

(56) References Cited

U.S. PATENT DOCUMENTS 2,996,994 A * 8/1961 Wright ..... 417/420
5,308,229 A 5/1994 DuPuis
5,616,973 A 4/1997 Khazanov et al.
5,833,437 A * 11/1998 Kurth et al. ..... 417/36
6,121,698 A 9/2000 Sexton
6,213,736 B1 * 4/2001 Weisser ..... 417/420
6,551,075 B2 * 4/2003 Gabrieli et al. ..... 417/365

FOREIGN PATENT DOCUMENTS

| | | |
|---|---|---|
| CH | 614760 | 12/1979 |
| DE | 1149448 | 5/1963 |
| DE | 1728505 | 8/1973 |
| DE | 3337086 | 5/1985 |
| DE | 3639719 | 6/1988 |
| DE | 4319619 | 12/1994 |
| DE | 4434461 | 3/1996 |
| DE | 19640155 | 4/1998 |
| DE | 19701993 | 7/1998 |
| DE | 29814116 | 1/1999 |
| FR | 2008305 | 1/1970 |
| WO | WO03/095842 | 11/2003 |

* cited by examiner

*Primary Examiner*—Thanh Lam
(74) *Attorney, Agent, or Firm*—Fulbright & Jaworski LLP

(57) ABSTRACT

Described is a drive motor, in particular for a pump, which has a rotor having a drive shaft, and a stator enclosed by a stator casing which is enclosed by an outer casing. The stator casing and the outer casing form an intermediate space which is hermetically sealingly closed off and which is filled with a cooling fluid. The cooling fluid is positively moved by means of a coolant impeller. For that purpose the coolant impeller is coupled to the drive shaft of the electric drive motor by means of a permanent magnet coupling which is in the form of a synchronous coupling, a hysteresis coupling or an eddy current coupling.

7 Claims, 10 Drawing Sheets

DRIVING MOTOR, ESPECIALLY FOR A PUMP

CROSS-REFERENCE TO RELATED APPLICATIONS

This application is a national stage filing of PCT/DE03/01462 filed May 7, 2003, claiming priority to DE 102 20 477.2 filed May 7, 2002 and DE 103 17 492.3 filed Apr. 16, 2003.

TECHNICAL FIELD

The invention is directed to a drive motor, in particular for a pump.

BACKGROUND OF THE INVENTION

In pumps the medium to be conveyed, that is to say to be pumped, is usually employed directly as a coolant for the drive motor of the pump. When dealing with sewage or waste water or other contaminated fluids that can result in blockage of the cooling volume of the drive motor. In addition pumps and in particular sewage pumps are known, which have an internal cooling system for their drive motor. In such an arrangement circulation of the coolant is effected by an additional small coolant impeller. That coolant impeller can be operatively connected to its own small electric motor. Another possible option involves driving the above-mentioned small coolant impeller directly by the pump drive motor. In that case either the coolant impeller is provided at the free end of the drive shaft of the drive motor, associated with the pump impeller, or the drive shaft of the drive motor is prolonged on the side remote from the free shaft end thereof and the coolant impeller is disposed on the side of the drive motor, which is remote from the pump impeller. In those known pumps, irrespective of the respective arrangement of the coolant impeller, it is necessary for the coolant circuit to be sealed off in relation to the drive motor and possibly the medium being conveyed, that is to say sewage, by means of dynamic seals. Dynamic seals however are subject to leakage which cannot be reliably excluded. Such leakage results for example in the danger that, in the extreme case, the cooling system fails or coolant penetrates into the drive motor.

CH 614 760 A5 discloses a canned centrifugal pump having a magnetic coupling whose outer part which surrounds the can and whose inner part which is surrounded by the can are provided with bar-shaped permanent magnets which are disposed in axis-parallel mutually juxtaposed relationship. The pump casing, the rotor of the canned centrifugal pump and the inner coupling part of the magnetic coupling preferably comprise a temperature-resistant and/or acid-resistant plastic material in order to provide a powerful, gland-less chemical canned centrifugal pump which makes it possible to achieve operationally reliable protection from corrosion. The side faces and the end faces of the permanent magnets which are completely embedded in the inner coupling part converge outwardly. Bearing substances are embedded in the plastic material, in the region of the bearing surfaces of the interconnected parts of the magnetic coupling. In that known canned centrifugal pump the permanent magnet coupling serves for mechanically coupling the pump drive motor to the pump impeller.

A canned centrifugal pump with a permanent magnet coupling is also known for example from DE 33 37 086 C2. That known centrifugal pump with a magnetic coupling has a can cup of plastic material which has a reinforcement at least in its axial can region. The can cup of plastic material is enclosed from the outside by a cup-shaped jacket of high-quality steel which serves as a shape stabiliser and holder for the can. In this case also the permanent magnet coupling is provided for connecting the pump drive motor to the pump impeller, in which respect, even at higher pressures and temperatures of the respective medium being conveyed, the can cup of plastic material is of maximum possible stability and good heat dissipation out of the region of the can cup is possible.

DE 36 39 719 C3 describes a canned magnetic pump with a pump casing, a pump impeller and a magnetic coupling having an outer drive part and an inner rotary part magnetically coupled thereto, wherein the outer drive part and the inner rotary part are hermetically sealed from each other by a can cup. A partial flow of the delivery flow of the canned motor pump, which is branched from that delivery flow and which serves to lubricate the pump plain bearings and possibly for dissipating heat losses from the magnetic coupling and bearing heat, is passed through the interior of the can cup. The end, near the pump, of the tube-like part of the can cup has a connecting flange which projects away from the axis of rotation of the magnetic coupling and with which it is fixed to the pump casing. The can cup can be subjected to the action of a heating means which is independent of the medium being conveyed, in order to provide a canned magnetic pump which, while being relatively simple to produce, enjoys a relatively wide range of uses both at high and also at lower temperatures of the medium being conveyed, wherein the can cup affords an enhanced level of security in an accident or damage situation. For that purpose, in that known canned magnetic pump, at least the tube-like part of the can cup is of an at least double-wall configuration and is formed by at least two can walls which are arranged concentrically relative to each other and relative to the axis of rotation of the magnetic coupling. The internal wall space formed by the double or multiple wall structure serves to receive a heating or cooling agent. Provided in the connecting flange which is mechanically firmly and sealingly connected to the can walls are at least one feed passage leading to the internal wall space and at least one discharge passage for the heating agent or coolant. In this known canned magnetic pump the magnetic coupling also serves for operatively connecting the drive motor thereof to the pump impeller.

DE 43 19 619 A1 discloses a submersible motor-driven pump with an electric drive motor, under which is fixed the casing of a centrifugal pump, wherein the casing of the drive motor is coaxially surrounded on the outside by a cooling jacket through which flows the medium to be conveyed. In this case therefore the medium to be conveyed, that is to say to be pumped, is used as a coolant, which—as has been stated in the opening part of this specification—can result in blockage of the cooling jacket when dealing with sewage or waste water or other contaminated fluids. Such a blockage can then lead to overheating of the drive motor and, in the extreme case, total failure thereof.

DE 44 34 461 A1 discloses a submersible motor-driven pump for heavily contaminated fluids. In order to permit cleaning of deposits in the interior of the pump, the submersible motor-driven pump which is provided with a tangential pressure connection and a jacket space which encloses the drive motor and through which the fluid being conveyed flows has a flushing connection which is arranged at the end of the jacket space, that is remote from the pump, the flushing connection being connectable to an external fluid source. The flushing connection is preferably provided with a releasably fixed closure cap provided with a vent system. That represents a structural complication and expenditure which is not to be disregarded.

A cooling unit for cooling submersible mud, sewage and sludge motor-driven pumps for the purposes of dry installation is known from DE 196 40 155 A1. That known cooling unit represents a separate construction without fixed structural connection to the submersible motor-driven pump.

DE 298 14 113 U1 discloses a permanent magnet coupling pump with a pump unit having a rotor which is arranged in a can cup and which is coupled to a driver of a drive unit, which driver extends around the can cup and can be driven in rotation by means of a drive motor. That known permanent magnet coupling pump has a cage which is connected at its one end to the pump unit and which is connected at its opposite end to the drive motor. The driver and the drive motor are drivingly connected by way of a drive means of a material which is a poor conductor of heat. The drive means can be in the form of a coupling or can have a coupling which is interposed into the drive shaft provided between the driver and the drive motor. The coupling is in the form of a dog coupling, an elastomer coupling or a permanent magnet coupling.

The object of the present invention is to provide a drive motor in particular for a pump, which has an internal cooling system which is statically hermetically sealed off.

BRIEF SUMMARY OF THE INVENTION

That object is attained in accordance with the invention by the features of claim 1. Preferred configurations and developments of the drive motor according to the invention are characterised in the appendant claims.

The drive motor according to the invention has the advantage that it does not come directly into contact with the medium to be conveyed such as sewage or waste water or another contaminated fluid so that the risk of the cooling system of the drive motor becoming blocked is eliminated. A further, quite considerable advantage is that dynamic seals are avoided, so that corresponding leakage effects are reliably excluded. With the drive motor according to the invention, the permanent magnet coupling does not serve for coupling the drive shaft of the drive motor to the pump impeller but it serves for coupling the drive shaft of the drive motor to the coolant impeller of the hermetically sealed cooling system of the electric drive motor.

The cooling system according to the invention can be used not only in relation to pumps, in particular sewage and waste water pumps, but in relation to any electric drive motor with a hermetically sealed cooling system. Instead of a pump impeller, it is therefore also possible to provide or mount on the drive shaft of the electric drive motor, any other per se known machine component such as a belt pulley, a V-belt pulley, a toothed belt pulley or the like.

Further details, features and advantages will be apparent from the description hereinafter of embodiments illustrated by way of example in the drawing of a drive motor according to the invention for a pump, in particular a sewage or waste water pump.

DETAILED DESCRIPTION OF THE INVENTION

Figure 1:
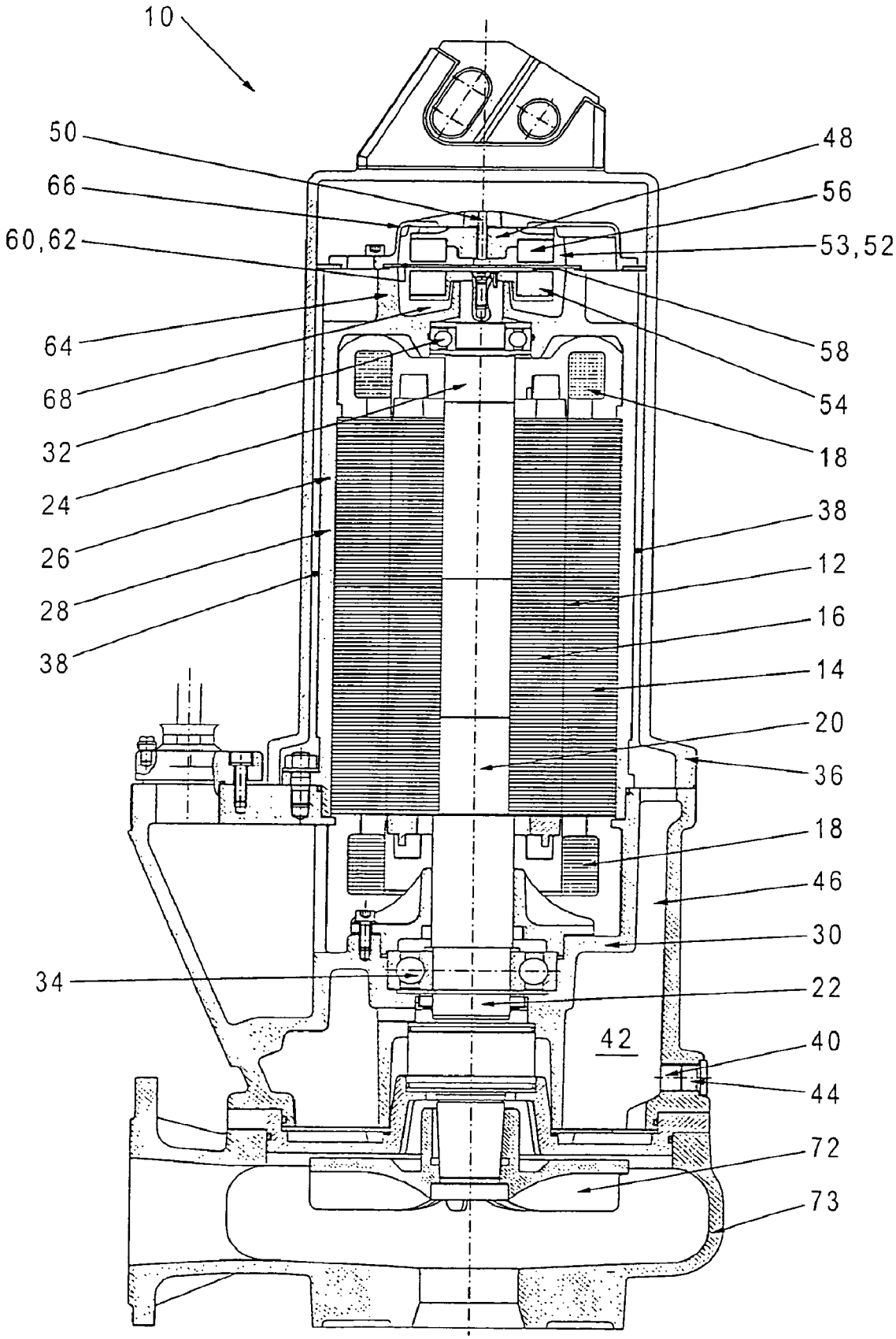
FIG. 1 shows a view in longitudinal section of a first embodiment of a pump with a permanent magnet coupling between the drive shaft of the electric drive motor and the coolant impeller of the statically hermetically sealed cooling system of the drive motor, wherein the permanent magnet coupling is in the form of a synchronous coupling with first and second permanent magnet devices.

FIG. 1 is a view in longitudinal section of a pump 10 which in particular is a sewage or waste water pump. The pump 10 has an electric drive motor 12 with a stator 14 and a rotor 16. The winding ends of the stator winding of the stator 14 are denoted by reference 18. The rotor 16 is non-rotatably connected to a drive shaft 20. The drive shaft 20 has a front end portion 22 and a rear end portion 24 which project away from each other out of the rotor 16.

The stator 14 of the electric drive motor 12 is sealingly enclosed by a stator casing 26. The stator casing 26 has a cup-shaped main casing portion 28 and a front casing portion 30 sealingly connected thereto.

The drive shaft 20 of the electric drive motor 12 is dynamically supported with its rearward end portion 24 by means of a bearing element 32 at the main casing portion 28 of the stator casing 26. The drive shaft 20 is also dynamically supported with its front end portion 22 by means of a bearing element 34 in the front casing portion 30 of the stator casing 26.

The stator casing 26 is enclosed by an outer casing 36 which is spaced from the stator casing 26 so that an intermediate space 38 is provided between the stator casing 26 and the outer casing 36. The intermediate space 38 can be filled with a cooling fluid 42 through a filling opening 40. After complete filling of the intermediate space 38 with the cooling fluid 42 the filling opening 40 is sealingly closed by means of a closure element 44, thereby affording a hermetically sealed cooling system 46 for the electric drive motor 12. The cooling fluid 42 provided in the intermediate space 38 of the hermetically sealed cooling system 46 is positively moved in operation of the electric drive motor 12, that is to say during rotation of the rotor 16, by means of a coolant impeller 48, in order to provide optimum cooling of the electric drive motor 12.

The coolant impeller 48 is rotatably mounted on a shaft 50 and coupled, that is to say operatively connected, to the drive shaft 20 of the electric drive motor 12 by means of a permanent magnet coupling 52.

Figure 2:
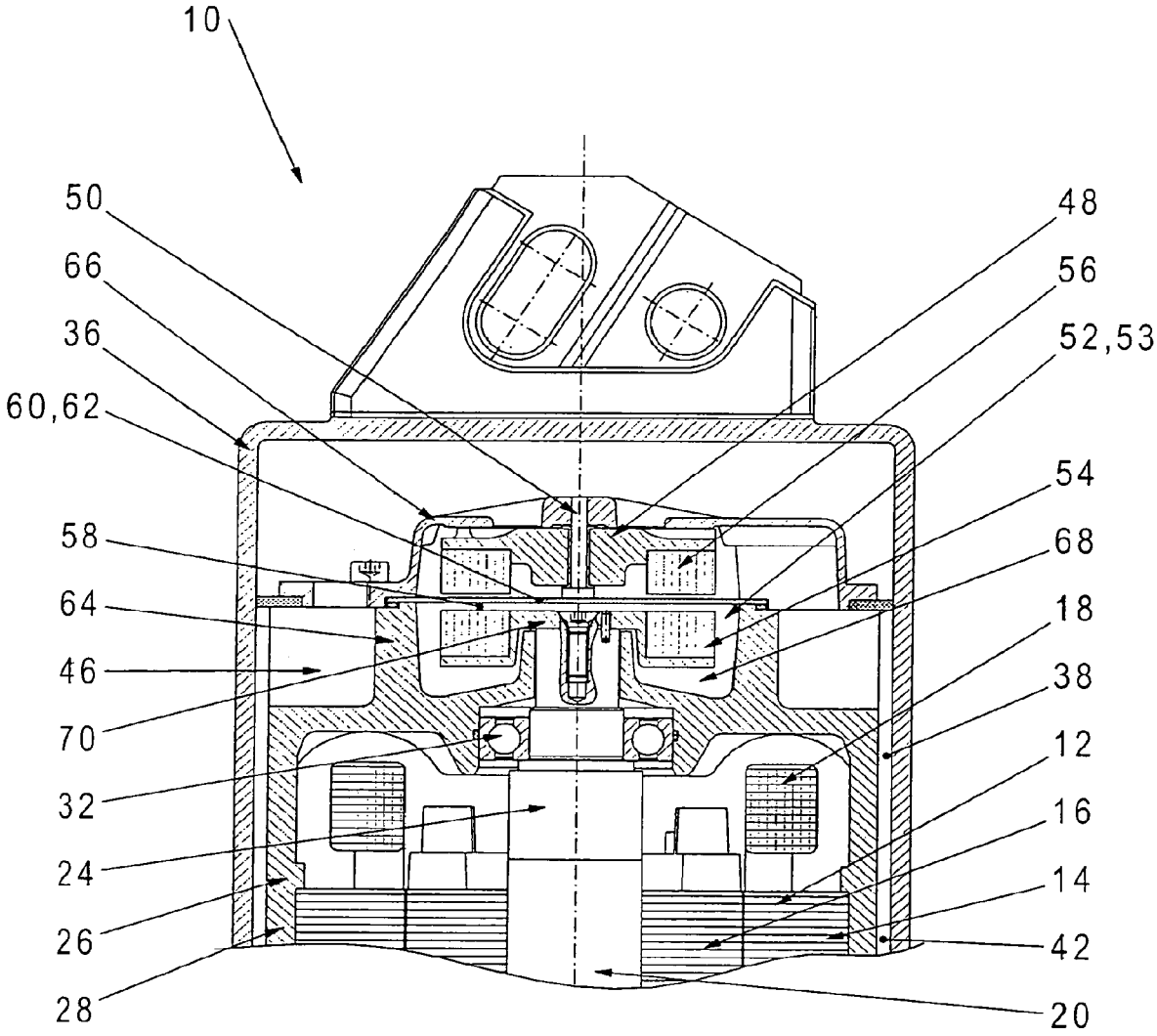
FIG. 2 shows the upper portion of the drive motor of FIG. 1 on a larger scale for further improved illustration of the permanent magnet coupling in the form of a synchronous coupling.

As is in particular clearly visible also from FIG. 2, the permanent magnet coupling 52 is in the form of a synchronous coupling 53 comprising a first permanent magnet device 54 and a second permanent magnet device 56 which are spaced from each other by a gap 58 in which there is provided a partition element 60. The partition element 60 comprises a non-magnetisable material. The permanent magnet devices 54 and 56 are of a flat-faced disk-shaped configuration and are axially spaced from each other in order to form the gap 58. The partition element 60 is in the form of a plate element 62 which is sealingly secured to an annular collar 64 of the main casing portion 28 of the stator casing 26. For that purpose, the partition element 60 formed by the plate element 62 is clamped in sealing relationship between the annular collar 64 of the main casing portion 28 of the stator casing 26 and a cap element 66. The shaft 50 for the coolant impeller is fixed between the cap element 66 and the plate or partition element 60, 62.

The partition element 60 formed by the plate element 62 and the annular collar 64 of the main casing portion 28 of the stator casing 26 form a dry space portion 68 in which the first permanent magnet device 54 is provided. The first permanent magnet device 54 is fixed to a carrier 70 which is accurately positioned at the end of the rearward end portion 24 of the drive shaft 20, that is to say it is accurately centrally positioned and fixed in such a way as to avoid an unbalance.

As can be seen from FIG. 1, a pump impeller 72 is fixed to the front end portion 22 of the drive shaft 20.

In the embodiment of the drive motor shown in FIGS. 1 and 2 the first permanent magnet device 54 and the second permanent magnet device 56 are formed from face rotational coupling elements of a flat-faced, annular disk configuration. In comparison, FIGS. 3 and 4 show a pump 10 with a permanent magnet coupling 52 between the drive shaft 20 of the electric drive motor 12 and the coolant impeller 48, wherein the first permanent magnet device 54 and the second permanent magnet device 56 are in the form of central coupling elements arranged in mutually concentric relationship.

The annular first and the annular second permanent magnet devices 54 and 56 are radially definedly spaced from each other so that between them there is an annular gap 58 in which there is a partition element 60 which is in the form of a cup.

In this embodiment also, the partition element 60 is sealingly clamped between the annular collar 64 of the main casing portion 28 of the stator casing 26 and a cap element 66, thus affording a dry space portion 68 in which the first permanent magnet device 54 is arranged.

Figure 3:
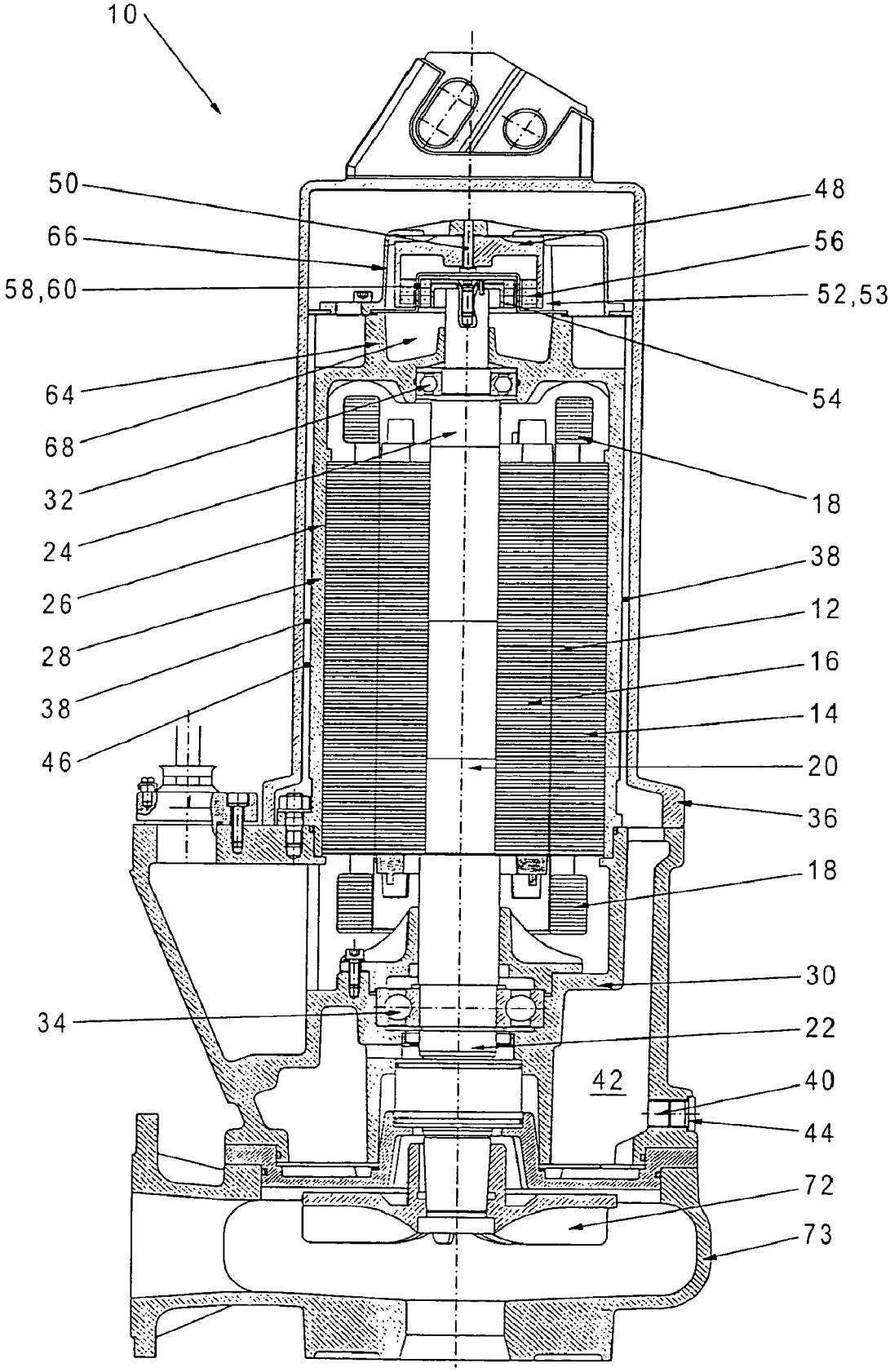
FIG. 3 shows a view in longitudinal section similar to FIG. 1 of a second embodiment of the drive motor of a pump, in particular a sewage or waste water pump, with another configuration of the permanent magnet coupling formed by a synchronous coupling.
Figure 4:
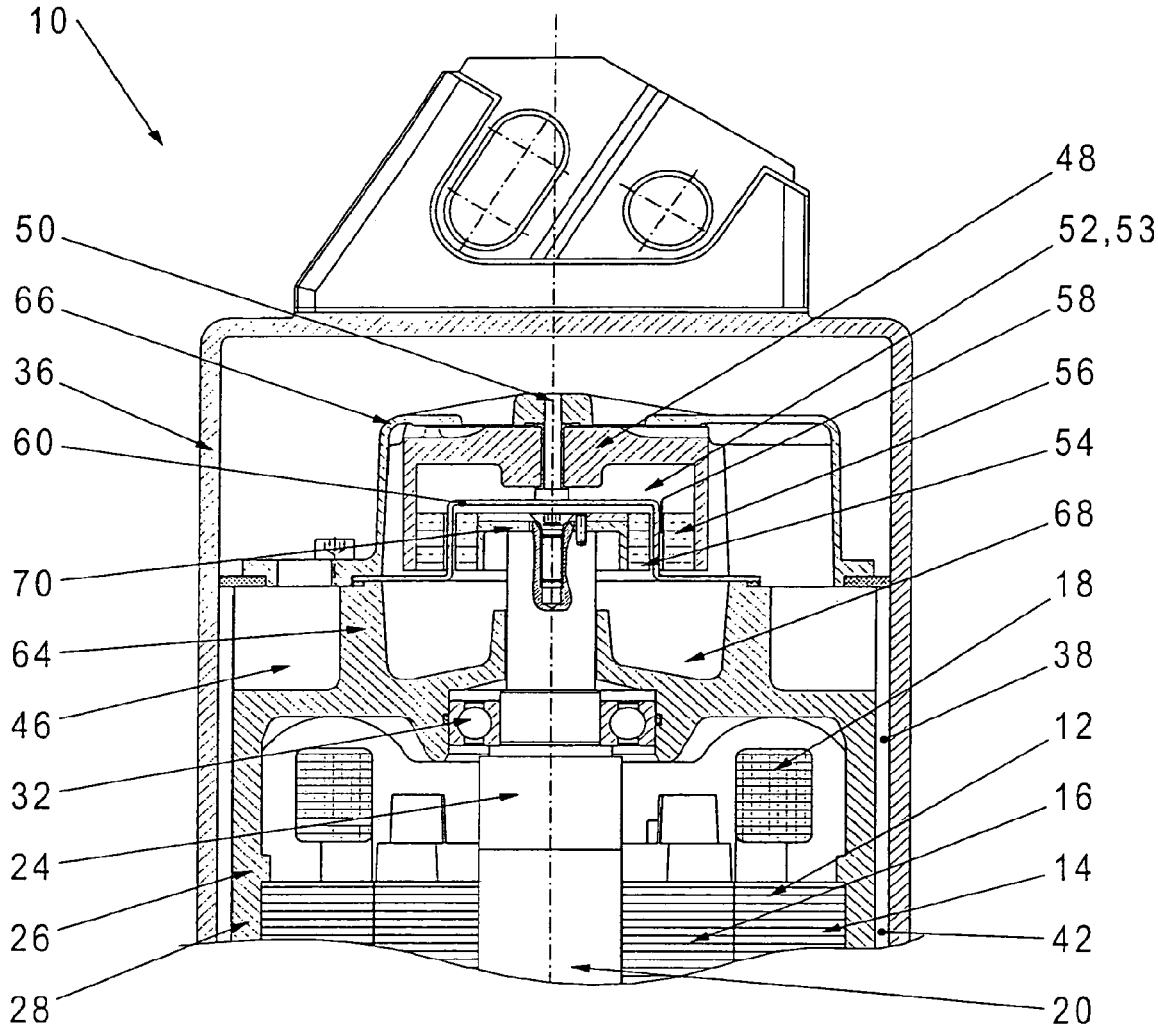
FIG. 4 is a view similar to FIG. 2 of the upper portion of the drive motor shown in FIG. 3 on a larger scale for further improved illustration of the permanent magnet coupling in the form of a synchronous coupling.

Identical details are denoted in FIGS. 3 and 4 by the same references as in FIGS. 1 and 2 so that there is no need for all those features to be described in detail once again, in connection with FIGS. 3 and 4.

Figure 5:
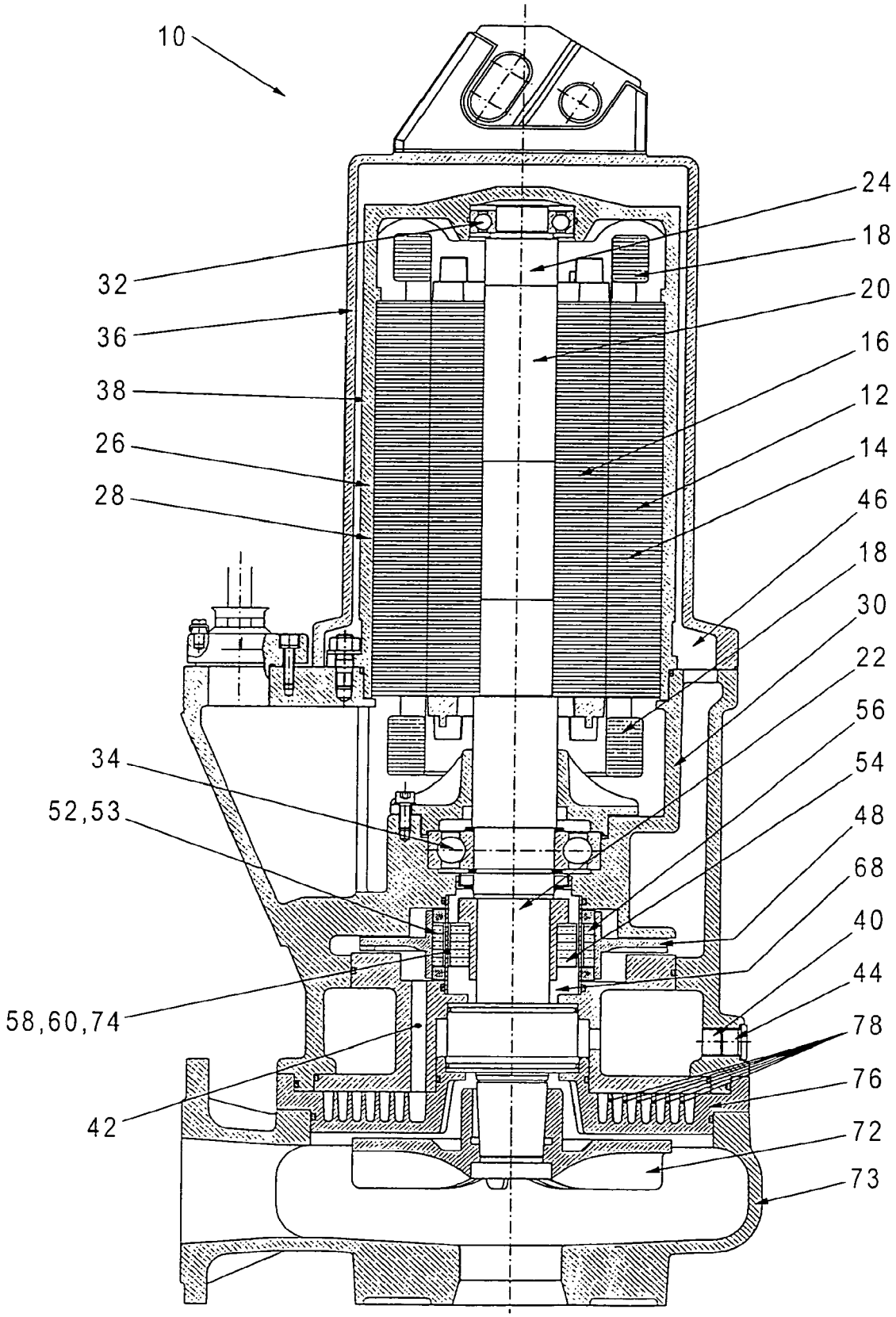
FIG. 5 shows a view in longitudinal section similar to FIGS. 1 and 3 of a third embodiment of a pump, in particular a sewage or waste water pump, with a permanent magnet coupling which is formed by a synchronous coupling but which is provided on the drive shaft between the rotor of the drive motor and the pump impeller.
Figure 6:
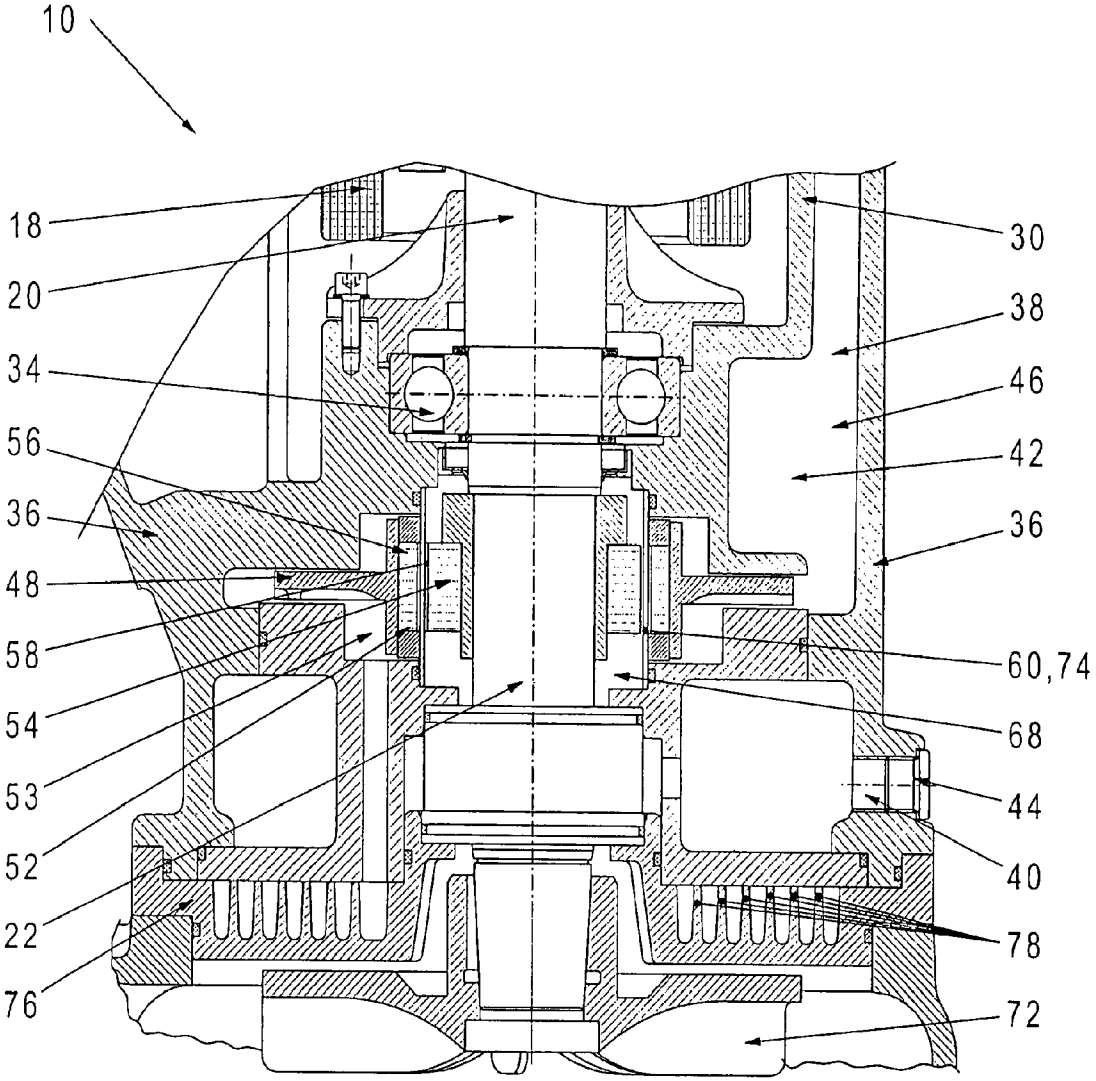
FIG. 6 shows the lower portion of FIG. 5 on a further enlarged scale for further improved illustration in particular of the synchronous coupling.

FIGS. 5 and 6 show an embodiment of the drive motor of a pump in which the permanent magnet coupling 52 with the coolant impeller 48 is provided not at the rear end portion 24 of the drive shaft 20 of the electric drive motor 12—as in the embodiments of FIGS. 1 and 2 and FIGS. 3 and 4 respectively—but at the front end portion 22 of the drive shaft 20. In this embodiment also, the permanent magnet coupling 52 is in the form of a synchronous coupling 53 having a first permanent magnet device 54 and a second permanent magnet device 56 which are spaced from each other by an annular gap in which there is a partition element 60. The first permanent magnet device 54 is fixed to the front end portion 22 of the drive shaft 20. The second permanent magnet device 56 is combined with or fixedly connected to a coolant impeller 48. The partition element 60 is in the form of a cylindrical sleeve 74 which is fixed to the front casing portion 30 of the stator casing 26 in order to afford a dry space portion 68.

In order further to improve the cooling of the cooling fluid 42 provided in hermetically sealed relationship in the intermediate space 38, a casing portion 76 of the pump 10 has cooling ribs 78 which project into the intermediate space 38 which is hermetically sealed off and which is filled with the cooling fluid 42. The cooling ribs 78 provide for an increase in surface area and thus provide for optimum cooling of the cooling fluid 42.

The same features are identified in FIGS. 5 and 6 by the same references as in FIGS. 1 through 4, so that there is no need for all those features to be described once again, in connection with FIGS. 5 and 6.

Figure 7:
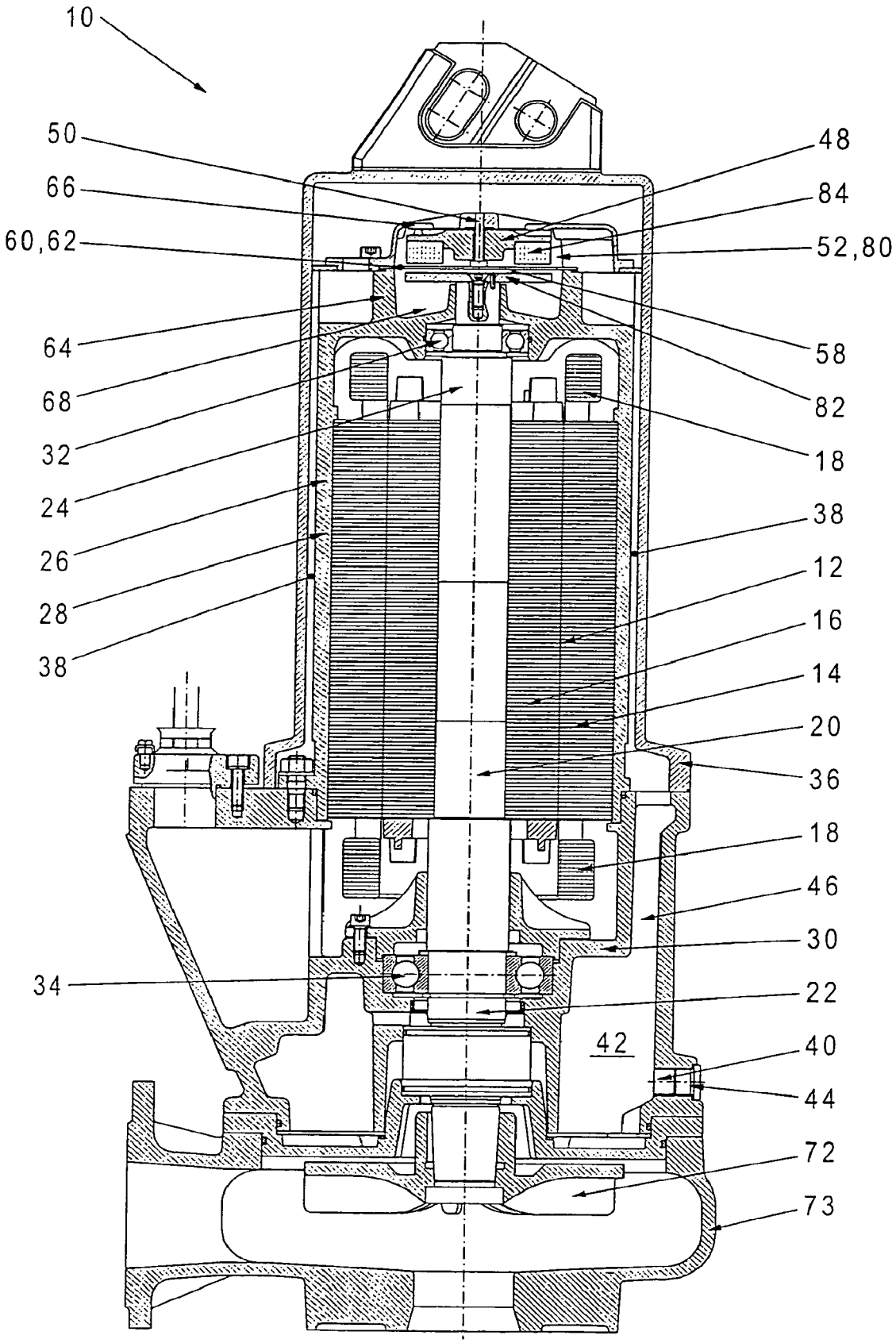
FIG. 7 is a view in longitudinal section similar to FIGS. 1, 3 and 5 of a fourth embodiment of a pump with a permanent magnet coupling between the coolant impeller and the drive shaft of the electric drive motor, the permanent magnet coupling being formed by a hysteresis coupling.
Figure 8:
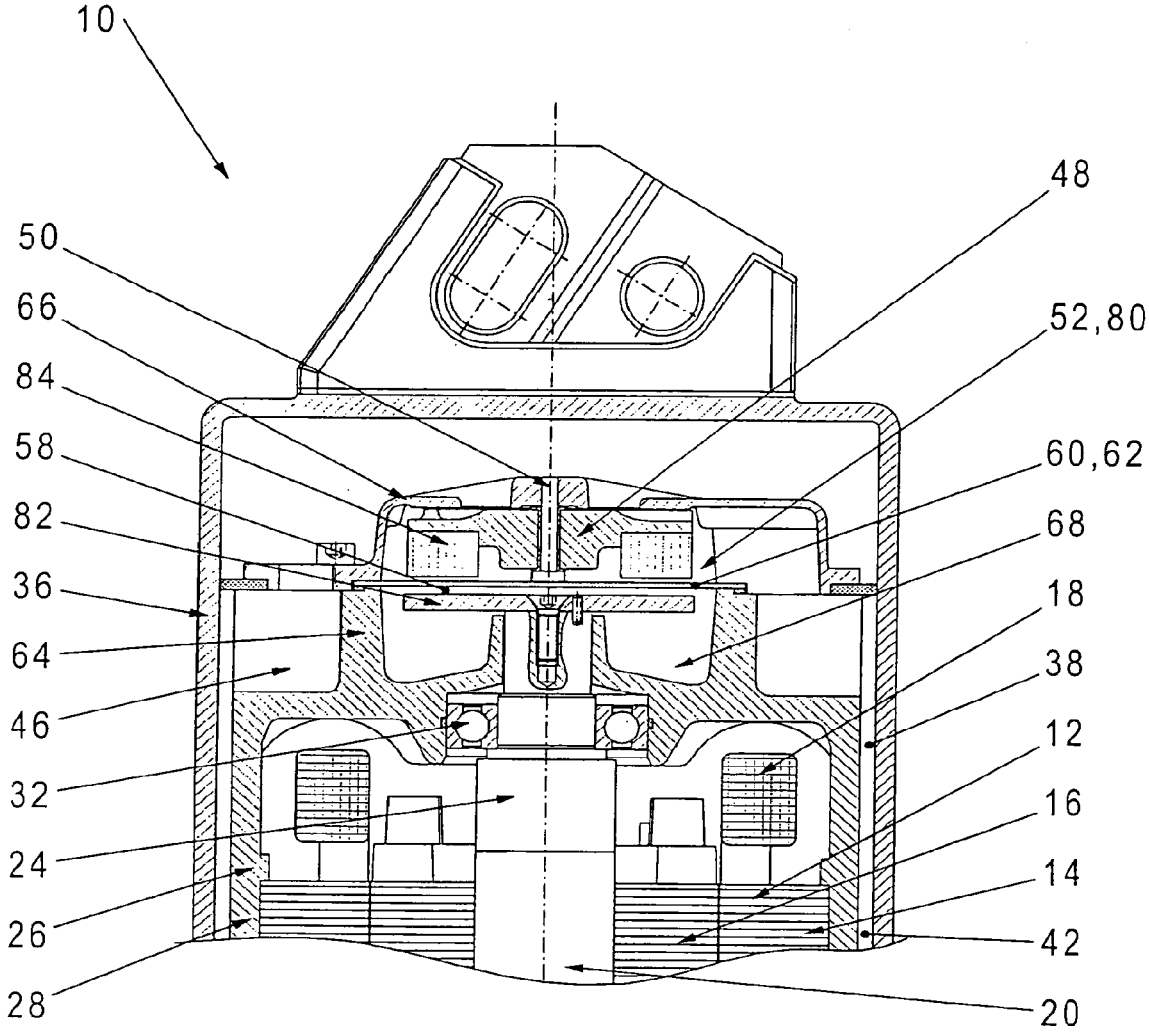
FIG. 8 shows the upper portion of FIG. 7 on an enlarged scale—similarly to FIGS. 2, 4 and 6—for further illustrating the hysteresis coupling.

FIGS. 7 and 8 show an embodiment of the drive motor of a pump, which differs from the embodiment of the pump 10 shown in FIGS. 1 and 2 in that the permanent magnet coupling 52 between the drive shaft 20 of the electric drive motor 12 of the pump 10 and the coolant impeller 48 is not in the form of a synchronous coupling but in the form of a hysteresis coupling 80 having a hysteresis surface element 82 and a permanent magnet device 84 which are spaced from each other by a gap 58 in which there is provided a partition element 60 comprising a non-magnetisable material. The permanent magnet device 84 is combined with, that is to say fixedly connected to, the coolant impeller 48. The hysteresis surface element 82 is fixedly connected to the drive shaft 20. The hysteresis surface element 82 comprises a magnetic material of relatively high remanence and relatively low coercive field strength so that magnetic reversal is possible against a relatively low resistance. While a synchronous coupling does not exhibit any slip, a hysteresis coupling has a certain slip and consequently a power loss caused by the transmission mechanism of the coupling.

Except for the permanent magnet coupling 52 the pumps 10 shown in FIGS. 1 and 2 and FIGS. 7 and 8 are in principle of a similar configuration so that there is no need for all features to be described in detail once again with reference to FIGS. 7 and 8.

Figure 9:
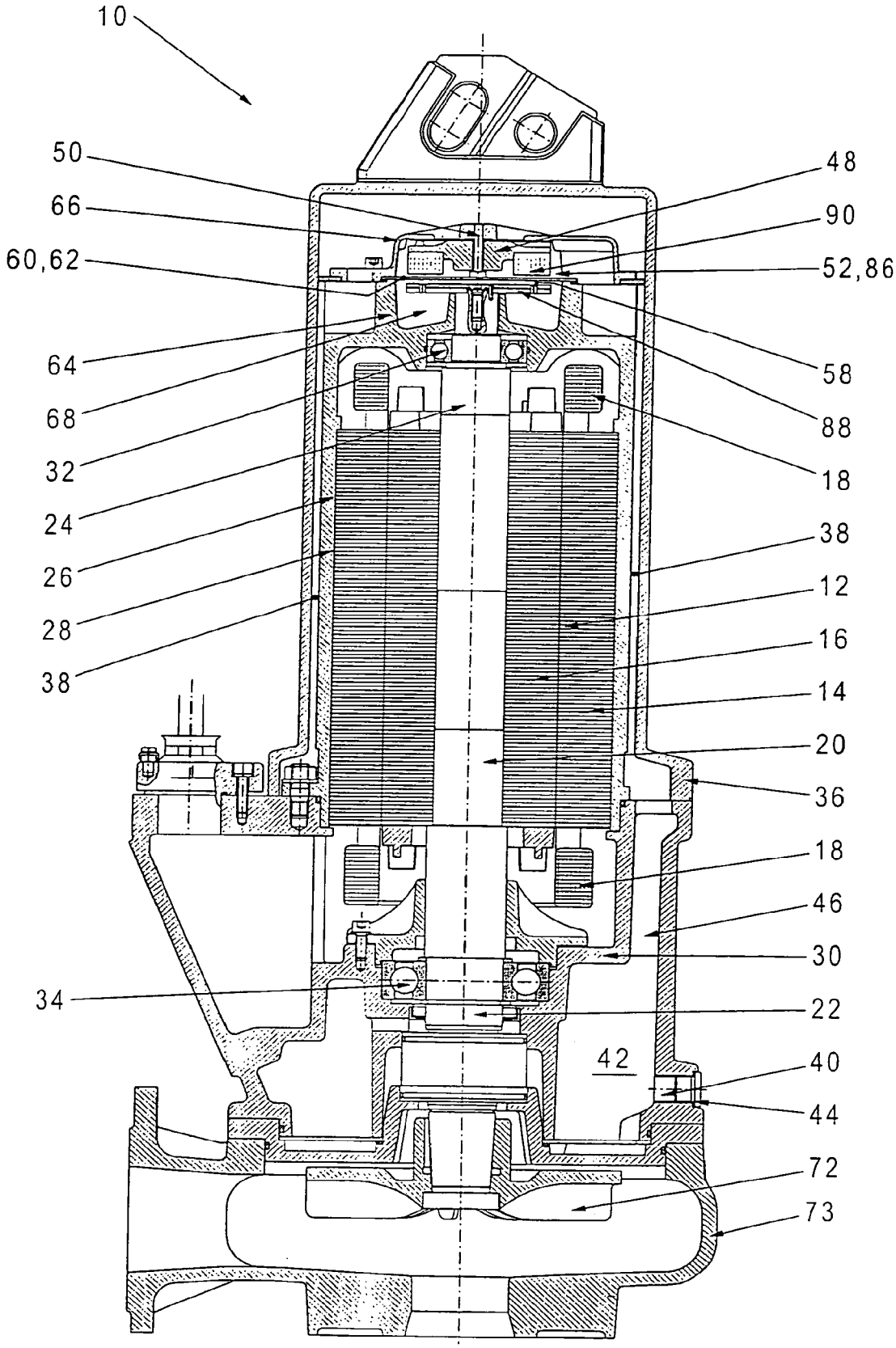
FIG. 9 is a view in longitudinal section similar to FIGS. 1, 3, 5 and 7 of a fifth embodiment of a pump with a permanent magnet coupling formed by an eddy current coupling.
Figure 10:
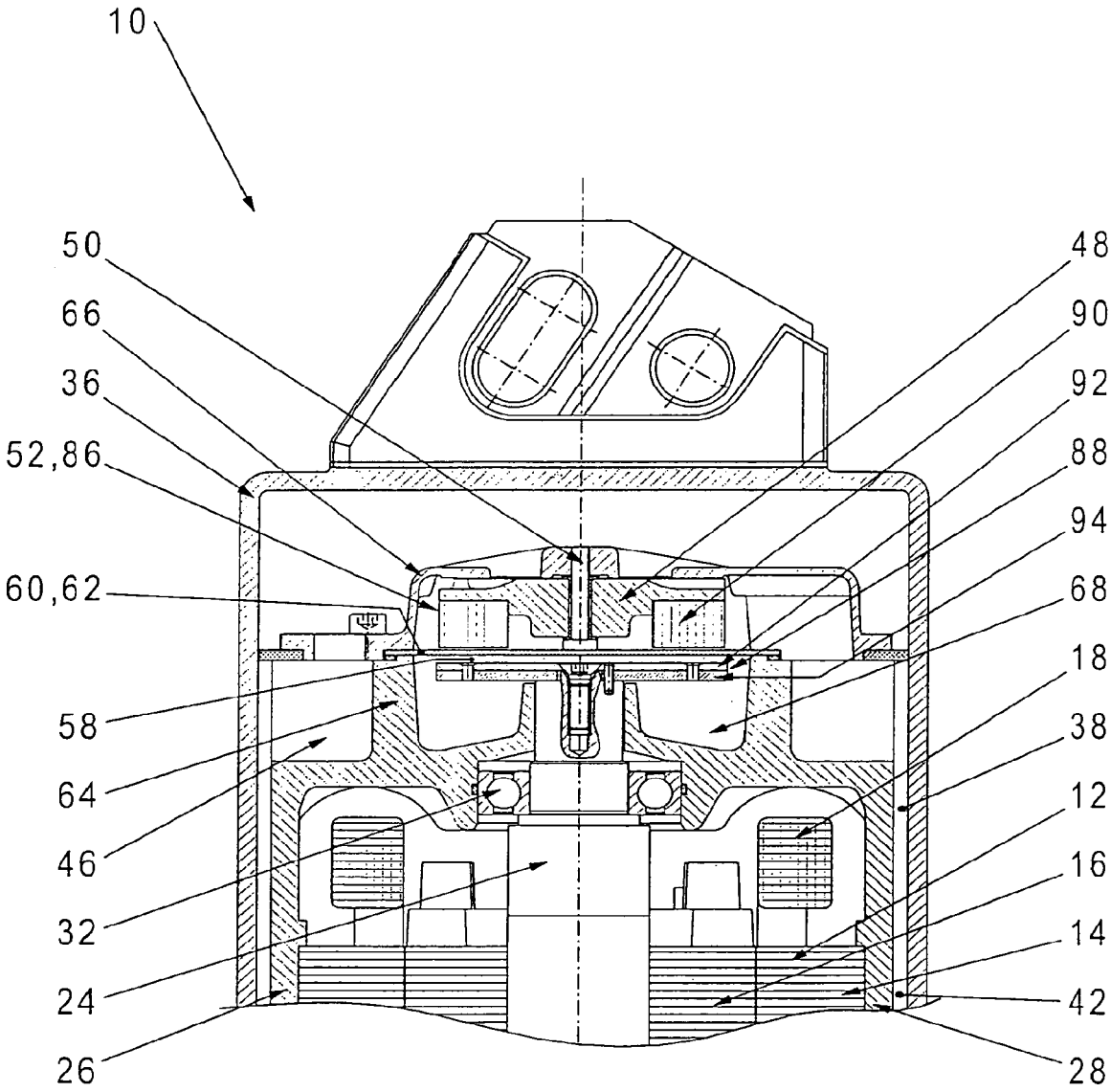
FIG. 10 shows the upper portion of FIG. 9 on an enlarged scale for further improved illustration of the eddy current coupling between the drive shaft of the electric drive motor and the coolant impeller of the hermetically sealed cooling system of the electric drive motor.

FIGS. 9 and 10 show an embodiment of the drive motor of a pump 10 similar to the pumps 10 shown in FIGS. 1 and 2 and shown in FIGS. 7 and 8, wherein the pump 10 shown in FIGS. 9 and 10 has a permanent magnet coupling 52 which is not formed either by a synchronous coupling (see FIGS. 1 and 2) or by a hysteresis coupling (see FIGS. 7 and 8), but by an eddy current coupling 86 having an eddy current surface element 88 and a permanent magnet device 90. The permanent magnet device 90 is fixedly connected to the coolant impeller 48. The eddy current surface element 88 is fixed to the drive shaft 20 of the electric drive motor 12. The eddy current surface element 88 comprises a surface element 92 comprising an electrically conductive material such as copper or the like and a surface element 94 comprising a soft-magnetic material, those elements being fixedly connected together, for example riveted. Moreover the pump shown in FIGS. 9 and 10 is of a similar configuration to the pumps 10 shown in FIGS. 1 and 2 and FIGS. 7 and 8 so that there is no need for all features to be described in detail once again, with reference to FIGS. 9 and 10.

The same details are identified in FIGS. 1 through 10 by the same respective references. FIGS. 1, 3, 5, 7 and 9 also show a pump casing 73.

It will be appreciated that the invention is not limited to the configurations illustrated in the drawing of the electric drive motor with a hermetically sealed cooling system 46 whose coolant impeller 48 is coupled to the drive shaft 20 of the drive motor 12 by means of a permanent magnet coupling 52.

What is claimed is:

1. A drive motor, in particular for a pump, comprising:

a rotor having a drive shaft, and a stator enclosed by a stator casing which is enclosed by an outer casing, wherein the stator casing and the outer casing form a sealed intermediate space which is statically closed in itself and which is filled with a cooling fluid which is positively moved by means of a coolant impeller, in which the cooling fluid in the sealed space forms a hermetically sealed cooling system, wherein the coolant impeller is coupled to the drive shaft by means of a permanent magnet coupling.

2. The drive motor as set forth in claim 1, wherein the permanent magnet coupling is in the form of a synchronous coupling with a first permanent magnet device and a second permanent magnet device which are spaced from each other by a gap in which there is provided a partition element of non-magnetisable material, wherein the first permanent magnet device is connected to the drive shaft and the second permanent magnet device is combined with the coolant impeller.

3. The drive motor as set forth in claim 2, wherein the first permanent magnet device is provided in a dry space portion of the stator casing, which is sealingly closed by the partition element and separated from the intermediate space filled with the cooling fluid.

4. The drive motor as set forth in claim 2, wherein the first and second permanent magnet devices are of a flat-faced disk-shaped configuration and are in the form of face rotational coupling elements axially spaced from each other, and that the partition element provided in the axial flat gap between the first and second permanent magnet devices is in the form of a plate element which is fixed sealingly to the stator casing.

5. The drive motor as set forth in claim 2, wherein the first and second permanent magnet devices are of an annular configuration and arranged concentrically relative to each other are in the form of a central coupling element.

6. The drive motor as set forth in claim 5, wherein the partition element provided in the radial annular gap between the first and second permanent magnet devices is in the form of a cup which is fixed sealingly to the stator casing.

7. The drive motor as set forth in claim 1, wherein the permanent magnet coupling with the coolant impeller is provided on a portion of the drive shaft, which is remote from the pump impeller.

* * * * *